US005562164A

United States Patent [19]

McMurray

[11] Patent Number: 5,562,164

[45] Date of Patent: Oct. 8, 1996

[54] FIRE SUPPRESSION SYSTEM FOR MULTI-STORY BUILDING DUMB WAITERS

[75] Inventor: Michael J. McMurray, Owings, Md.

[73] Assignee: The United States of America as represented by the Secretary of the Army, Washington, D.C.

[21] Appl. No.: 530,390

[22] Filed: Sep. 15, 1995

[51] Int. Cl.[6] ..... A62C 3/00

[52] U.S. Cl. ..... 169/54; 169/11; 169/16; 169/60

[58] Field of Search ..... 169/45, 54, 16, 169/11, 60, 61

[56] References Cited

U.S. PATENT DOCUMENTS

| | | | |
|---|---|---|---|
| 2,311,374 | 2/1943 | Farmer et al. | 169/61 |
| 2,586,797 | 2/1952 | Dunlop et al. | 169/54 |
| 3,782,474 | 1/1974 | Wiseman | 169/45 |
| 3,884,133 | 5/1975 | Miller | 169/61 |
| 4,002,229 | 1/1977 | Washington | 169/61 |
| 4,054,084 | 10/1977 | Palmer | 169/61 |
| 4,058,253 | 11/1977 | Munk et al. | 169/61 |

FOREIGN PATENT DOCUMENTS

| | | | |
|---|---|---|---|
| 403286785 | 12/1991 | Japan | 169/61 |
| 161234 | 9/1962 | U.S.S.R. | 169/16 |
| 1496806 | 7/1989 | U.S.S.R. | 169/54 |
| 1553147 | 3/1990 | U.S.S.R. | 169/45 |
| 1669455 | 8/1991 | U.S.S.R. | 169/54 |

*Primary Examiner*—Gary C. Hoge

*Attorney, Agent, or Firm*—Freda L. Krosnick; Muzio B. Roberto

[57] ABSTRACT

A fire suppression system for a dumb waiter for carrying hazardous materials in a multiple story building includes an exhaust at the top of the shaft, a storage compartment for carbon dioxide gas above the topmost floor served by the dumb waiter, a first nozzle in the shaft near the top thereof, a second nozzle in the shaft near the bottom thereof, and conduits interconnecting the storage compartment and the nozzles. The system further includes vapor detectors in the shaft, each of which is adapted, upon detection of unsafe vapors in the shaft, to open the conduits to flow the carbon dioxide gas from the storage compartment to the nozzles and thence into the shaft above and below the dumb waiter, and to shut down operation of the exhaust.

15 Claims, 1 Drawing Sheet

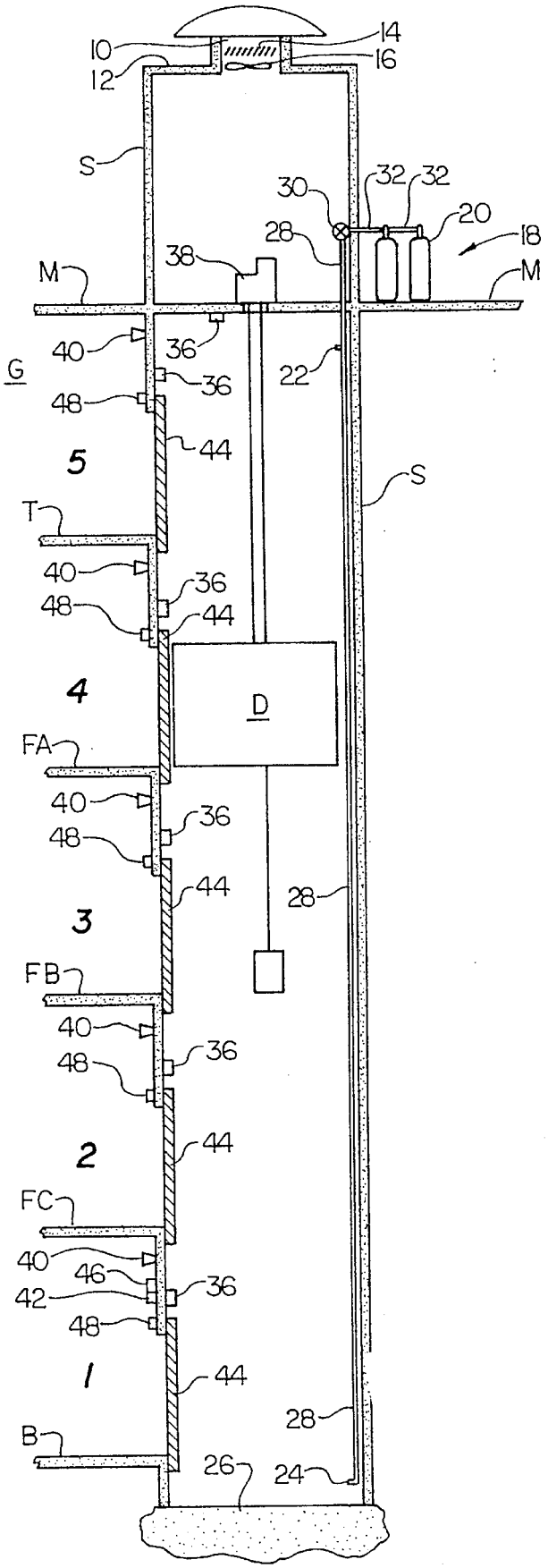
10
12
14
16
S
30
32
32
20
18
28
38
M
M
40
36
G
36
22
48
44
5
S
T
40
36
48
44
4
D
FA
40
36
48
44
28
3
FB
40
36
48
44
2
FC
40
46
42
36
48
1
44
28
B
26
24

FIRE SUPPRESSION SYSTEM FOR MULTI-STORY BUILDING DUMB WAITERS

STATEMENT OF GOVERNMENT INTEREST

The invention described herein may be manufactured, used and licensed by or for the Government for Governmental purposes without the payment to me of any royalty thereon.

BACKGROUND OF THE INVENTION

1. Field of the Invention

This invention relates to fire suppression systems and is directed more particularly to a system used in conjunction with a dumb waiter for carrying hazardous materials between floors of a multiple story building.

2. Description of the Prior Art

Sprinkler systems are commonly used to contain or control fire in dumb waiter shafts in multi-story buildings, including in dumb waiters used for carrying hazardous materials, usually chemicals. In such systems, water is used to dilute and wash down spilled materials.

The sprinkler systems in use usually include at least one vapor detector and at least one pull station for each floor. The vapor detectors monitor vapors that have been released into the dumb waiter shaft and automatically activate the suppression system. The pull stations allow for manual activation of the suppression system. The sprinkler systems further include one or more spinkler heads at the top of the shaft, a sump pump for removing water and spilled chemicals from the bottom of the shaft, and a holding tank where water and spilled chemicals pumped from the bottom of the shaft are stored.

When activated, current sprinkler systems release water from the sprinkler head at the top of the shaft. The water flows down the shaft, mixes with spilled chemicals, or the like, and collects at the bottom of the shaft. The sump pump pumps the water and chemicals into the holding tank. Typically, the water is released into the shaft at a rate of 30–40 gallons per minute, and a holding tank of 3,000 gallon capacity is used. Thus, in a little over an hour the tank is nearly filled. If the holding tank reaches capacity, water begins to fill the shaft.

Since the water will have mixed with the chemicals, all of the water must be treated as hazardous waste. It is necessary that the water (with chemical therein) be tested, containerized, and transported to an approved site. Vapors are exhausted to the environment through a roof fan. The dumb waiter system must remain shut down until all water has been removed and the shaft has been decontaminated. If water has seeped from the shaft, those areas of the building affected must also be decontaminated, and must remain closed until the cleanup is complete. It is not unusual for the dumb waiter system to be shut down for two or more days.

There is a need for a fire suppression system which permits faster cleanup and results in a lesser volume of contaminated material for testing, containerizing and shipping to disposal sites.

SUMMARY OF THE INVENTION

An object of the invention is, therefore, to provide a fire suppression system for use in conjunction with a dumb waiter for carrying hazardous materials between floors of a multiple story building.

A further object of the invention is to provide such a system permitting faster cleanup of affected shafts and reduced volume of hazardous materials.

A still further object of the invention is to provide such a system which is readily incorporated into existing dumb waiter structures, replacing the prior art sprinkler systems, but utilizing many of the components of the sprinkler systems.

With the above and other objects in view, as will hereinafter appear, a feature of the present invention is the provision of a fire suppression system for a dumb waiter for carrying, in a dumb waiter shaft, hazardous materials between floors of a multiple story building. The system includes an air exhaust proximate the top of the shaft, storage means for carbon dioxide gas, a first nozzle disposed in the shaft proximate the top of the shaft, a second nozzle disposed in the shaft proximate the bottom of the shaft, and conduit means interconnecting the storage means and the nozzles. The system further includes vapor detectors in the shaft, each of the vapor detectors being adapted, upon detection of unsafe vapors in the shaft, to open the conduit means to flow the carbon dioxide gas from the storage means to the nozzles, and to shut down the air exhaust, whereby the flow the carbon dioxide gas from the nozzles into the shaft above and below the dumb waiter while the air exhaust is closed.

The above and other features of the invention, including various novel details of construction and combinations of parts, will now be more particularly described with reference to the accompanying drawings and pointed out in the claims. It will be understood that the particular system embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings:

THE FIGURE is a diagrammatic illustration, partly in section and partly in elevation, of one form of fire suppression system illustrative of an embodiment of the invention.

DESCRIPTION OF THE PREFERRED EMBODIMENT

Referring to the FIGURE, it will be seen that the illustrative fire suppression system is used in conjunction with a shaft S, in which is movably disposed a dumb waiter D. The dumb waiter D is moveable between an uppermost floor T served by the dumb waiter and a lower most floor B served by the dumb waiter, and floors FA, FB and FC therebetween, and, in the usage contemplated herein, carries hazardous materials, such as chemicals, from floor to floor of a building G.

The illustrative system includes an exhaust 10 proximate a top 12 of the shaft S. The exhaust 10 includes shutters 14 movable between open and closed positions, and a fan 16 for blowing air and other gases out of the shaft S and into the atmosphere.

The system further includes storage means 18 for carbon dioxide gas ($CO_2$), the storage means 18 being on, or proximate, a machinery floor M of the building G, normally disposed above the uppermost floor T served by the dumb waiter D. The storage means 18 may be inside the shaft S, or proximate thereto, as shown in the FIGURE. The $CO_2$ storage means 18 may comprise bottles 20 containing $CO_2$ under pressure.

A first $CO_2$ discharge nozzle 22 is mounted in the shaft S proximate the underside of the machinery floor M, and a second $CO_2$ discharge nozzle 24 is mounted in the shaft proximate a bottom 26 of the shaft. Conduits 28 interconnect the $CO_2$ storage means 18 and the first and second nozzles 22, 24. An electrically activated trip valve 30 is disposed in a portion 32 of the conduits 28 leading from the $CO_2$ storage means, such that opening of the valve 30 releases $CO_2$ gas into the conduits 28 and, thence, to the nozzles 22, 24 from whence the $CO_2$ is discharged into the shaft S above and below the dumb waiter D. When the storage means 18 comprises $CO_2$ bottles 20, conduit portions 32 are connected to the bottles 20.

Vapor detectors 36 are spaced throughout the shaft S, preferably with a vapor detector 36 disposed at each floor of the building. Each of the vapor detectors 36 is in communication with an electrical drive means 38 which operates the dumb waiter D, the exhaust 10, and the $CO_2$ conduit trip valve 30. When a detector 36 senses an unsafe level of vapors in the shaft, the detector operates to close the exhaust 10, open the valve 30, and shut down the dumb waiter electrical drive unit 38. Opening the valve 30 causes discharge of $CO_2$ gas into the shaft S, where the $CO_2$ remains, in view of the closure of the exhaust 10.

In operation, upon detection of unsafe vapors in the shaft S, the exhaust 10 is shut down, that is, the shutters 14 are closed and the fan 16 is stopped, the dumb waiter D stops its movement in the shaft, and $CO_2$ gas is flowed from the nozzles 22, 24 into the shaft, above and below the dumb waiter. The automatic operation, as described, stabilizes the situation and eliminates the occurrence of explosion, fire, toxicity build-up, and the like, in the shaft. The $CO_2$ immediately isolates any chemicals in the dumb waiter D or at the bottom 26 of the shaft S.

The system is provided with an audible alarm 40, which is activated by the vapor detectors simultaneously with the exhaust 10, $CO_2$ valve 30, and dumb waiter drive means 38. Typically, a Hazardous Material Response Team (HMRT) is on the scene within minutes of the sounding of the alarm 40.

The system provides manually activated overrides for use by the HMRT. A manually-activated switch 42 operates to override the shut down of the dumb waiter drive unit 38 and, upon activation, signals the drive unit 38 to lower the dumb waiter D to the lowermost floor B. At each floor, including the lowermost B, there is a door 44 which may be opened to remove chemicals from the dumb waiter.

The system further includes a manually-activated switch 46 for overriding the shut down of the exhaust 10, permitting the HMRT to evacuate the shaft S when conditions are suitable.

On each of the floors T, FA, FB, FC, and B, outside the shaft S and adjacent the door 44, there is disposed a pull station 48, which may be activated manually and which, once activated, operates in the same manner as the vapor detectors 36. That is, upon operation of a pull station 48, the pull station signals the exhaust 10 to close and shut down, the $CO_2$ valve 30 to open, the dumb waiter drive unit 38 to shut down, and the alarm 40 to sound. The alarm 40 typically is an audible alarm, but may be visual, or a combination of audible and visual.

After the shaft is exhausted, the only contaminated material in the shaft is the chemical itself, which usually is of a very small quantity, greatly reducing the amount of material which must be handled as contaminated. Further, because of the substantially air-tight construction of such shafts, leakage of contaminated material into the building from the shaft is most unlikely. Thus, there is provided a system which is very quick to respond to a problem, and which facilitates relatively quick and inexpensive clean-up, and limited down-time.

The system described herein is readily retro-fitted into shafts equipped with sprinkler systems. The shaft itself is virtually unchanged; the exhaust usually is already in place; the nozzles and conduits are typically present in sprinkler systems; space for water storage may be converted to space for $CO_2$storage; and alarm systems are present in sprinkler systems, as are pull stations.

It is to be understood that the present invention is by no means limited to the particular construction herein disclosed and/or shown in the drawings, but also comprises any modifications or equivalents within the scope of the claims.

Having thus described my invention, what I claim as new and desire to secure by Letters Patent of the United States is:

1. A fire suppression system for a dumb waiter for carrying in a shaft hazardous materials between floors of a multiple story building, said system comprising:

an exhaust for evacuating gas from said shaft to the atmosphere;

storage means for carbon dioxide gas;

at least one nozzle disposed in said shaft;

at least one conduit interconnecting said storage means and said at least one nozzle; and vapor detector means in said shaft, said vapor detector means being adapted, upon detection of unsafe vapors in said shaft, to open said at least one conduit to flow said carbon dioxide gas from said storage means to said at least one nozzle and thence, into said shaft, and to stop operations of said exhaust.

2. The system in accordance with claim 1 wherein said exhaust comprises shutters for opening and closing the exhaust and a fan for forcing movement of gas from said shaft.

3. The system in accordance with claim 2 wherein said exhaust is disposed at the top of said shaft.

4. The system in accordance with claim 3 wherein said storage means comprises bottles of pressurized carbon dioxide gas.

5. The system in accordance with claim 4 wherein said at least one conduit comprises conduits interconnecting said bottles of carbon dioxide gas and said at least one nozzle.

6. The system in accordance with claim 5 wherein said at least are nozzle comprises a first nozzle proximate said top of said shaft and a second nozzle proximate the bottom of said shaft.

7. The system in accordance with claim 1 wherein said vapor detection means includes vapor detectors spaced throughout said shaft.

8. The system in accordance with claim 7 wherein at least one of said vapor detectors is disposed at each floor of said building served by said dumb waiter.

9. A fire suppression system for a dumb waiter for carrying in a shaft hazardous materials between floors of a multiple story building, said system comprising:

an exhaust proximate the top of said shaft;

storage means for carbon dioxide gas disposed above the topmost floor served by the dumb waiter;

a first nozzle disposed in said shaft proximate said top of said shaft;

a second nozzle disposed in said shaft proximate a bottom of said shaft;

at least one conduit interconnecting said storage means and said nozzles; and vapor detectors in said shaft, at least one of said vapor detectors being disposed at each floor served by the dumb waiter, each of said vapor detectors being adapted upon detection of vapors in said shaft of an unsafe level, to open valve means in said at least one conduit to flow said carbon dioxide gas from said storage means to said nozzles, to shut down said air exhaust, and to stop an electrical dumb waiter drive system;

whereby to flow said carbon dioxide gas from said nozzles into said shaft above and below said dumb waiter while said air exhaust is closed.

10. The system in accordance with claim 9 wherein said system further comprises manually activated means for lowering said dumb waiter to a lowermost floor served by said dumb waiter.

11. The system in accordance with claim 9 wherein said system further comprises manual means for activating said exhaust.

12. The system in accordance with claim 9 wherein said system further includes an alarm automatically activated by said vapor detectors.

13. The system in accordance with claim 9, further comprising a pull station on each floor served by said system, each of said pull stations being disposed outside of said shaft proximate a door of said shaft, and operable manually to close said exhaust, activate the flow of carbon dioxide gas into said shaft, and stop an electrical dumb waiter drive system.

14. The system in accordance with claim 9 wherein said vapor detectors are further adapted to activate an alarm.

15. The system in accordance with claim 13 wherein said pull stations are further adapted to activate an alarm.

* * * * *